United States Patent [19]

Welu

[11] 4,249,787

[45] Feb. 10, 1981

[54] NOVEL END-PRESSURE CONNECTION DEVICE

[75] Inventor: Prosper Welu, Le Plessis Trevise, France

[73] Assignee: S.E.P.M. Societe d'Exploitation des Procedes Marechal, Paris, France

[21] Appl. No.: 24,279

[22] Filed: Mar. 26, 1979

[30] Foreign Application Priority Data

Apr. 4, 1978 [FR] France ..... 78 10098

[51] Int. Cl.[3] ..... H01R 21/28

[52] U.S. Cl. ..... 339/64 R; 339/204; 339/205; 339/248 S; 339/255 R

[58] Field of Search ..... 339/248 R, 248 S, 48, 339/49 B, 64 R, 204, 205, 255 R, 254, 253, 222

[56] References Cited

U.S. PATENT DOCUMENTS

| | | | |
|---|---|---|---|
| 1,946,966 | 2/1934 | Douglas | 339/254 R X |
| 2,145,162 | 1/1939 | Douglas | 339/248 S |
| 2,463,145 | 3/1949 | Buchanan | 339/248 S |
| 3,171,183 | 3/1965 | Johnston | 339/255 R X |
| 3,241,136 | 3/1966 | Harrington | 339/255 X |
| 3,416,125 | 12/1968 | Theve | 339/255 R X |
| 3,813,638 | 5/1974 | Kinnear | 339/255 R X |

*Primary Examiner*—John McQuade
*Assistant Examiner*—John S. Brown
*Attorney, Agent, or Firm*—Edwin E. Greigg

[57] ABSTRACT

The invention relates to a novel end-pressure connection device to connect electrically at least two contacts in pin form. The device according to the invention is characterized in that it includes an insulating box in which is arranged at least one intermediate part or bar for each pair of pins to be placed in contact. The bar is formed of conducting material and each of its surfaces is provided with a contact stud designed to become applied on to the end of one of the pins in connecting position while at least one elastic means is arranged in said box so that it urges each stud of the bar towards the corresponding pin. The invention is particularly applicable to form a junction terminal or a power outlet.

10 Claims, 7 Drawing Figures

NOVEL END-PRESSURE CONNECTION DEVICE

BACKGROUND OF THE INVENTION

1. Field of the Invention

The invention relates to a novel end-pressure connection device for electrically connecting at least two contacts in pin form and more particularly to constitute a connecting terminal or a power plug.

2. Description of the Prior Art

To constitute end-pressure connection devices with at least two contacts, it has been conceived to mount one of the contracts in a base provided with an elastic means designed to urge said contact directly so that the contacts are applied against one another with pressure.

However such devices necessitate the connection of the elastic contact with a flexible wire to give it the necessary amplitude of compression. It is clear that such devices are unusable for numerous applications. This is why it has been conceived to constitute connectors and power plugs with end-pressure contacts by means of a hollow or solid conductive tress. Such connectors include, on the one hand, a "fixed" elastic contact formed from a wire grip or fixed lug, a tress, a spring and a contact head urged by said spring and, on the other hand, a movable pin contact formed from a wire grip or lug and a pin.

End-pressure contacts including a tress have numerous advantages in their applications. However difficulties appear at the level of connecting the parts constituting the fixed elastic contact as well as in the manufacture of the tress. In fact, it is necessary to obtain, for such devices, good elasticity of the tress with maximum passage cross-section for the current, high reliability of the tress on manipulation and lastly wire grip-tress and tress-contact head connections which result in a minimum voltage drop over time.

To obtain good elasticity and correct reliability of the tress, the wires of the latter must be selected to be very fine while their tress formation must be particularly careful. In addition, the cross-section of the tress is tied up with the dimensions of the equipment to be produced, which makes it possible only with considerable difficulty to achieve a tress cross-section equal to that of the conductors, especially for large cross-sections.

As regards the connections, it is possible to select between brazing and crimping. However brazing has the drawback of annealing the strands of the tress, which reduces its reliability on manipulation, whilst crimping which has greater reliability never gives a certainty of minimum voltage drop in time, which causes a risk of heating. Moreover, the force of plugging in such a device must not only overcome the compression of the spring, but also that of the tress.

It is therefore an object of the invention to provide an end-pressure connecting device wherein the voltage drop of the device is guaranteed over time since contrary to tressed devices, the voltage drops only exist at the points of contact.

It is another object to provide an end-pressure connection device which eliminates the drawbacks of brazing or of crimping of a tress and hence results in greater reliability of the device.

Another object of the invention is to provide a device in which the cross-section of the bar can be equal to those of the conductors, which reduces electrical resistance and hence heating.

Yet another object of the device according to the invention is simplification with respect to known tressed devices and elimination of checking the crimping and the like, which results in a reduction in cost price.

A further object is to provide a device in which the contacts are self-cleaning, on account of the friction of the pins on the studs at the moment of the placing in contact, due to the elastic movement of the bar.

GENERAL DESCRIPTION OF THE INVENTION.

According to the invention therefore, there is provided an end-pressure connection device designed to connect electrically at least two contacts in the form of identically- or unidentically-sized pins, characterized in that it comprises an insulating box in which is formed at least one intermediate part or bar for each pair of pins to be placed in contact, which is formed from a conducting material and of which each of the faces is provided with a contact stud designed to become applied on the end of one of the pins in connecting position, whilst at least one elastic means is arranged in said box so that it urges each stud of the bar towards the corresponding pin.

One embodiment according to the invention, in which for each pair of pins to be connected, the latter are aligned in their connecting position, is characterized in that it includes per pair of pins, a bar provided with a stud on each of its surfaces, said studs being arranged on both sides of the common axis of the pins whilst at least one spring is arranged in the box concentrically around the pins in the connecting position and urges the ends of the bar so that the latter takes up an inclined position whilst each stud is applied under pressure on the end of the corresponding pin.

In this case it includes either a spring, or two springs arranged on both sides of the bar.

Another embodiment in which for each pair of pins to be connected, the latter are arranged in their connecting position along two parallel but non-coaxial axes is characterized in that it includes per pair of pins, a bar provided with a stud on each of its surfaces, said studs being arranged on both sides of the middle axis comprised between the axes of said pins whilst two springs are arranged in housings of the box respectively on each side of the bar substantially coaxially with the pins in connecting position and act on the ends of the surfaces not including studs so that each stud is applied with pressure on the end of the corresponding pin.

For these two embodiments, advantageously the bar has a substantially rectangular shape and the studs a substantially hemispherical shape whilst the ends of the bar urged by the one or more springs are curved back in reverse direction so that the plane defined by each surface of the bar in the vicinity of the end not provided with a stud is substantially tangential to the stud arranged at the other end of said surface. A modification consists of giving the bar a substantially circular shape and arranging lugs on said bar which are urged and curved back as has just been stated with regard to the rectangular bar.

For a device in which for each pair of pins to be connected the latter are aligned in their connecting position, another embodiment of the connection device according to the invention is characterized in that it includes two bars arranged in an X each provided with a contact stud on each of its faces, the studs on one bar being arranged on both sides of the other bar whilst the springs are arranged between the ends of the bars, suitably curved back to this purpose, and urge said ends apart, the ends of the pins being advantageously rounded so that each pin in connecting position is in contact with a stud of each bar.

For a device in which for each pair of pins to be connected, the latter are arranged in their connecting position, along two parallel non-coaxial axes, another embodiment of the connecting device according to the invention is characterized in that it includes per pair of pins, a bar provided with a stud on each of its faces, said studs being arranged on both sides of the median axis comprised between the axes of said pins whilst the bar has an extension and a spring is arranged in a housing of the box and urges said extension, so that each stud is applied with pressure on the end of the corresponding pin.

The invention enables at least two applications to be realized. It can be designed to constitute a junction terminal for at least one pair of pins, the box being provided for each pair of pins with two insertion openings provided with temporary immobilization means in contact position designed to cooperate with conjugate means arranged on the pins, such as a bayonet system, for example. It may also be designed to constitute the fixed portion or base of a power plug, the box being provided with at least one fixed pin and with at least one insertion opening for the movable pin designed to be connected with said fixed pin.

BRIEF DESCRIPTION OF THE DRAWINGS

The invention will be better understood on reading the description which follows and on studying the accompanying drawings of some preferred embodiments which are not to be regarded as in any way limiting.

In the drawings.

DESCRIPTION OF PREFERRED EMBODIMENTS

Figure 1:
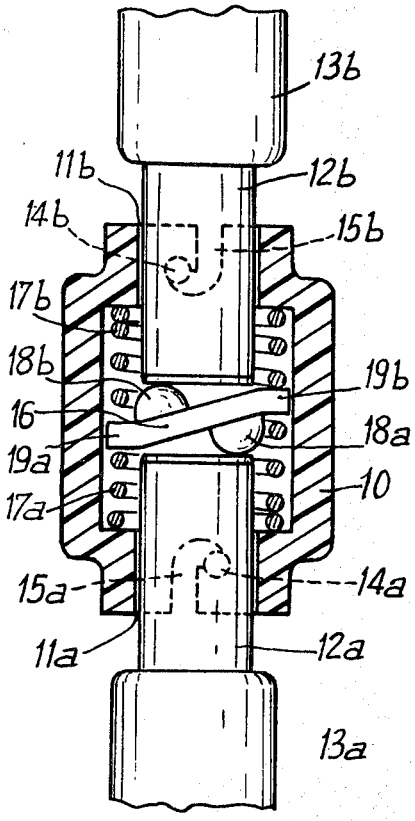
FIG. 1 shows diagrammatically in section an end-pressure connection device according to the invention in which the pins to be connected are aligned in their connecting position.

FIG. 1 shows a coaxial and single wire junction terminal according to the invention. This terminal includes a body or box 10, of insulating plastics material or coated with such a material, provided with two openings 11*a* and 11*b* designed to receive two pins respectively 12*a* and 12*b*. Pins 12*a* and 12*b* to be placed in electrical contact, are provided in known manner with insulating handles 13*a* and 13*b* and with guides and locking means designed to cooperate with the conjugate means arranged in the box such as the bayonet system shown and constituted by the spigots 14*a* and 14*b* of the pins and the guide and locking ramps 15*a* and 15*b* of the box.

Figure 2:
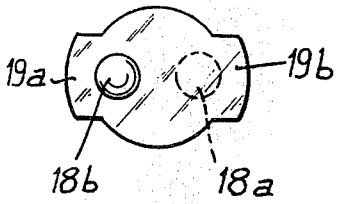
FIG. 2, shows in plan view the bar of FIG. 1, FIG. 3, shows diagrammatically in section an end-pressure connection device according to the invention in which the pins to be connected are arranged in their connecting position along two parallel but non-coaxial axes.

Inside the box of the embodiment of FIG. 1 is arranged transversely a bar 16 formed with a conducting material whilst two springs 17*a* and 17*b* are arranged on both sides of said bar. The latter has on each of its faces a contact stud 18*a* and 18*b*, for example of silver, and substantially hemispherical. The bar has in the example shown, a circular shape (FIG. 2) and it is provided with two lugs or the like 19*a* and 19*b*. The studs 18*a* and 18*b* are offset on both sides of the common axis of the pins, whilst the lugs 19*a* and 19*b* are slightly curved back in reverse direction to an extent such that the planes determined by said lugs 19*a* and 19*b* are substantially tangential to the studs 18*a* and 18*b* respectively. In addition, the springs 17*a* and 17*b* are clamped in the box 10 and arranged concentrically around the pins so that they thrust against said lugs 19*a* and 19*b* and so that the studs 18*a* and 18*b* are applied with pressure on to the corresponding pins 12*a* and 12*b* when the latter are in position.

From the foregoing the operation will be clear. Before the insertion of the pins, the bar is substantially horizontal and then inclined as shown in FIG. 1 in the course of the positioning of the pins whilst the springs 17*a* and 17*b* are compressed. It is possible to conceive an embodiment including only a single spring 17 instead of two springs 17*a* and 17*b*.

Figure 3:
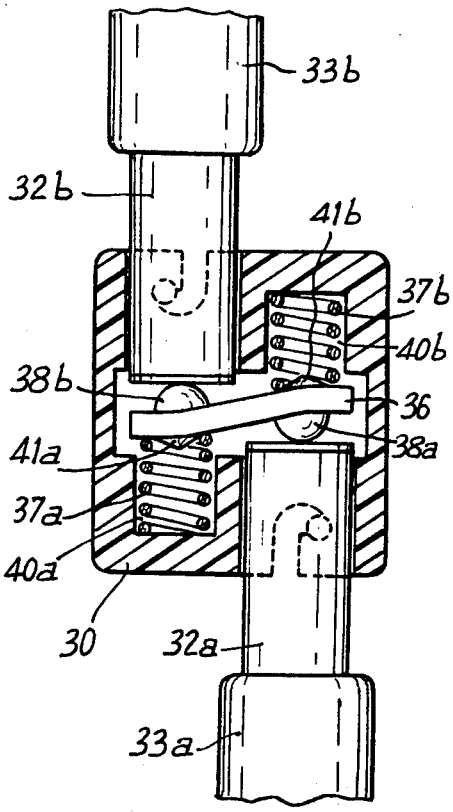

FIG. 3 shows an embodiment of another type of junction terminal for two pins designed to be connected along two parallel but non-coaxial axes.

Figure 4:
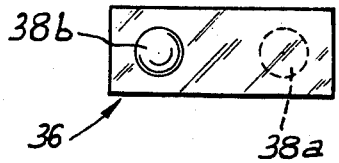
FIG. 4 shows in plan view the bar of FIG. 3.

This embodiment has a box 30 for two pins 32*a* and 32*b* provided with insulating handles 33*a* and 33*b*. In this embodiment, the bar 36 is also provided with two studs 38*a* and 38*b* which are arranged on both sides of the median axis comprised between the axes of said pins. Springs 37*a* and 37*b* are arranged in suitable housings 40*a* and 40*b* of the box 30. The housings 40*a* and 40*b* of the springs are arranged substantially coaxially with the pins respectively 32*b* and 32*a* and opposite studs 38*b* and 38*a* with respect to the bar so that said springs thrust against the latter to become applied suitably on the respective pins 32*b* and 32*a*. Here, the bar has the rectangular shape shown in FIG. 4. However, the bar could have the shape shown in FIG. 2, in the same way as the bar 16 of FIGS. 1 and 2 could have the shape shown in FIG. 4. In this example the ends of the bar 36 are slightly curved back in the manner already described with regard to the lugs of the bar 16.

Advantageously, protuberances 41*a* and 41*b* are arranged on the faces of the bar, opposite the studs respectively 38*b* and 38*a* so as to wedge the springs 37*a* and 37*b*.

The embodiment of FIG. 3 has the advantage of opposing additional wedging force when there is an inadvertant or accidental tension applied to one of the cables connected to the handles. In fact, if a pull is exerted on the handles 33*a* and 33*b*, the box 30 pivots and the pins 32*a* and 32*b* have a tendency to pivot in their housing and to be wedged. This advantage is useful in certain applications, as for example the junctions of cables for cinema studios, where the cables are not always handled with care.

Figure 5:
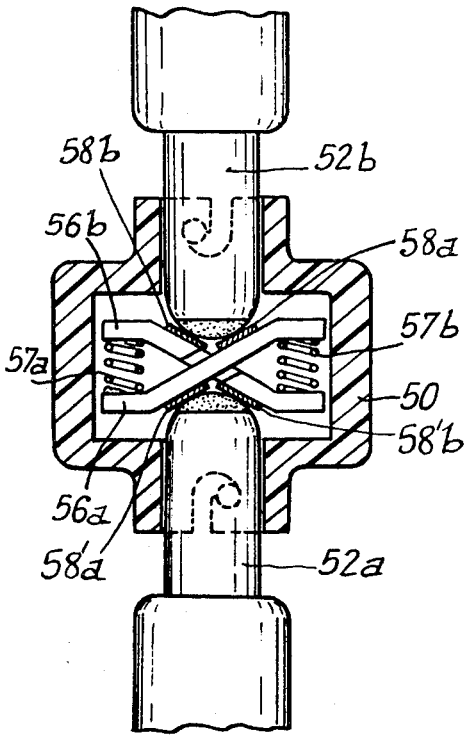
FIG. 5 shows in section another embodiment of an end-pressure connection device according to the invention in which the pins to be connected are aligned in their connecting position.

FIG. 5 shows a coaxial junction terminal on the type of that of FIG. 1. However here, in the box 50 are arranged two bars 56*a* and 56*b* arranged in an X and each provided with a contact stud 58*a*, 58'*a* and 58*b*, 58'*b* in the form of a pellet, on each of its faces. The studs 58*a*, 58'*a* of the bar 56*a* are arranged on both sides of the bar 56*b* and reciprocally. In addition, the ends of said bars are curved back and the springs 57*a* and 57*b* are arranged between said ends to urge the latter to separate.

The pins 52*a* and 52*b* are ends advantageously rounded so that each of said ends forms a contact with one stud of each bar. To obtain an X arrangement, numerous constructions are possible. Thus for example, one of the bars may have a central aperture traversed by the other bar or again the two bars can each have a discontinuity or central cutout to enable their pivoting by loose nesting.

FIGS. 1, 3 and 5 show junction terminals for two pins. It is obvious that it is possible to conceive without departing from the scope of the invention, junction terminals for several pairs of pins provided then with several bars. In addition, another application of the invention relates to power socket bases as shown in FIGS. 6 and 7.

In the embodiments of FIGS. 1, 3 and 5, if one of the pins is fixed in the box and connected to a current source, the device constitutes the fixed portion or base of a power socket. It is possible to produce power sockets according to the principles described with regard to the aforesaid figures and it is only one example that is shown in FIG. 6 and which takes up the principle described with regard to the junction terminal of FIG. 3. This FIG. 6 shows diagrammatically in part, the fixed element or base 60 of a power socket and its conjugate movable element 61. The base 60 includes the contact pin 62*b* and the movable element of pin 62*a* designed to be inserted in an opening or bushing of the base 60. The latter includes in the manner already described with regard to FIG. 3, a bar 66 and two springs 67*a* and 67*b*. Contrary to the junction terminal of FIG. 3, the terminal 62*b* is fixed in the base 60 and connected electrically by any conventional system such as the bushing 63 and the clamping screw 64. The power socket of FIG. 6 is shown in part and it is clear that it can include as many contacts as necessary.

Figure 6:
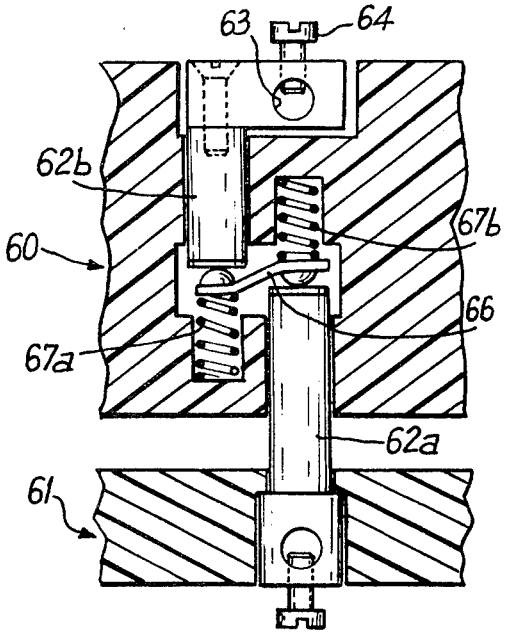
FIG. 6 shows diagrammatically in section a portion of a power plug base incorporating an end-pressure connection device according to the invention.
Figure 7:
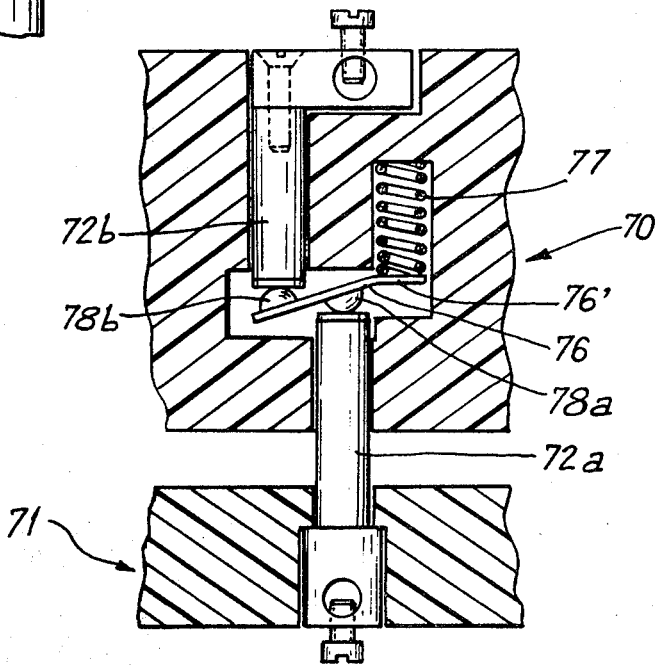
FIG. 7 shows diagrammatically in section another embodiment of a power plug base incorporating an end-pressure connection device according to the invention.

FIG. 7 also shows a power socket which is differentiated from that of FIG. 6 by the fact that the bar 76 has an extension 76' whilst the single spring 77 is arranged in a housing of base 70 of the power socket. Said spring 77 acts on the end 76' of the bar 76 which results in the application of the studs 78*a* and 78*b* of the latter on respectively the fixed pin 72*b* of the base 70 and the pin 72*a* of the movable element 71 of the socket. This arrangement results notably in economy of one spring and its housing. In addition, if FIG. 7 relates to a power socket, it is obviously possible to manufacture a junction terminal on this principle, the pin 72*b* then being also movable whilst immobilizing means for the pins in base 70 are provided and are, for example, of the shape described with regard to FIGS. 1, 3 and 5.

The invention relates to an end-pressure connection device whose embodiments and applications are multiple; numerous modifications may be envisaged therein without departing from its scope as defined by the appended claims.

I claim:

1. An end pressure electrical connection device for making an electrical connection between at least one pair of contacts in pin form, said device comprising an insulating box, at least one intermediate bar arranged in said box for each pair of pins to be placed in electrical contact, each pair of pins being axially aligned in their connecting position, said bar for each pair of pins being formed of a conductive material, each of the surfaces of said bar being provided with a contact stud adapted to become applied in electrical contact with one end of said pins in connecting position, said studs being arranged on both sides of the common axis of said pair of pins, at least one spring arranged in said box concentrically around said pair of pins when said pins are in a connecting position thereby urging the ends of said bar so that said bar takes an inclined position relative to an initial position of said bar before the pins are connected, whereby each stud is under pressure in electrical contact with the end of the corresponding pin.

2. An end pressure electrical connection device for making an electrical connection between at least one pair of contacts in pin form, said device comprising an insulating box, at least one intermediate bar arranged in said box for each pair of pins to be placed in electrical contact, each pair of pins to be connected are arranged in their connecting position along two parallel but non-coaxial axes, said bar being formed of a conductive material each of the surfaces of said bar being provided with a contact stud adapted to become applied in electrical contact with one end of one of said pins in connecting position, said studs being arranged on both sides of the median axis comprised between the axes of said pins, a pair of springs arranged in spring housings in said insulating box respectively on each side of said bar so as to be substantially coaxial with the pins in their connecting position to act on the stud free end surfaces of said bar so that each stud is under pressure in electrical contact with the end of the corresponding pin.

3. An end pressure electrical connection device for making an electrical connection between at least one pair of contacts in pin form, said device comprising an insulating box, at least one pair of intermediate bars arranged in said box for each pair of pins to be placed in electrical contact, each pair of pins being axially aligned in their connecting position, each of said bars being formed of a conductive material, said bars arranged as an X with each bar provided with a contact stud on each of its surfaces, the studs of one bar being arranged on each side of the other bar, a spring arranged between opposing ends of said pair of bars, each being curved back for this purpose thereby urging said ends of said bars to separate, the ends of the pins being rounded so that each pin in connecting position is in contact with a stud on each bar whereby each stud is under pressure in electrical contact with the end of the corresponding pin.

4. Device according to claim 1, including two springs arranged on opposite sides of the bar.

5. Device according to claim 1, wherein the bar has a substantially rectangular shape and the studs are substantially hemispherical shape whilst the ends of the bar urged by the one or more springs are curved back in reverse direction so that the plane defined by each surface of the bar in the vicinity of the end not provided with a stud is substantially tangential to the stud formed at the other end of said surface.

6. Device according to claim 1, wherein the bar has a substantially circular shape and the studs are substantially hemispherical shape, whilst lugs are arranged on the bar and are urged by the one or more springs and curved backwards in reverse direction so that the plane defined by each lug is substantially tangential to the stud of the surface concerned of the bar.

7. Device according to claim 1 or 2, constituting a junction terminal for at least one pair of pins, said box being provided for each pair of pins with two insertion apertures provided with temporary immobilization means in contact position designed to cooperate with conjugate means arranged on the pins.

8. Device according to claim 7, wherein said conjugate means is a bayonet system.

9. Device according to claim 2, wherein protuberances are arranged at the ends of the surfaces of the bar opposite the studs so as to serve as wedging elements for said springs.

10. Device according to claim 2, said insulating box constituting a fixed portion or base of a power outlet, said box being provided with at least one fixed pin and at least one insertion aperture for a movable pin designed to be connected with the fixed pin.

* * * * *